US005332098A

United States Patent [19]

Fisher

[11] Patent Number: 5,332,098

[45] Date of Patent: Jul. 26, 1994

[54] PORTABLE PREPARATION TOOL KIT FOR AUTOMOBILE BODY WORK

[75] Inventor: Steven M. Fisher, Los Angeles, Calif.

[73] Assignee: Fisher Tool Co., Inc., Los Angeles, Calif.

[21] Appl. No.: 175,112

[22] Filed: Dec. 29, 1993

Related U.S. Application Data

[63] Continuation-in-part of Ser. No. 719,948, Jun. 24, 1991, Pat. No. 5,259,914.

[51] Int. Cl.[5] ..... B32B 35/00

[52] U.S. Cl. ..... 206/576; 206/374; 51/170 PT

[58] Field of Search ..... 206/576, 373, 374, 375; 51/170 PT, 170 T, 170 MT; 15/28, 29, 97.1; 279/7; 408/226

[56] References Cited

U.S. PATENT DOCUMENTS

| | | | |
|---|---|---|---|
| 856,323 | 6/1907 | Wickes . | |
| 2,545,453 | 3/1951 | Forss . | |
| 2,570,009 | 10/1951 | Schmid . | |
| 2,607,232 | 8/1952 | Haase . | |
| 2,854,286 | 9/1958 | Salick . | |
| 3,104,569 | 9/1963 | Davis et al. . | |
| 3,251,086 | 5/1966 | Springer | 15/28 |
| 3,600,740 | 8/1971 | Ogier | 206/576 X |
| 4,131,966 | 1/1979 | Gross | 15/28 |
| 4,150,955 | 4/1979 | Samuelson . | |
| 4,197,061 | 4/1980 | Hill . | |
| 4,299,004 | 11/1981 | Lancaster | 51/170 T X |
| 4,629,374 | 12/1986 | Berner . | |
| 4,690,724 | 9/1987 | Outlaw . | |
| 4,866,319 | 9/1989 | Crutchfield . | |
| 5,005,807 | 4/1991 | Mathews et al. . | |
| 5,042,207 | 8/1991 | Kirn . | |
| 5,056,265 | 10/1991 | Hurst | 51/170 PT X |
| 5,088,242 | 2/1992 | Lubbering et al. | 51/170 T X |
| 5,190,620 | 3/1993 | Winter . | |

FOREIGN PATENT DOCUMENTS

| | | |
|---|---|---|
| 3030351 | 8/1980 | Fed. Rep. of Germany . |
| 2084059 | 4/1982 | United Kingdom . |
| 2114925 | 9/1983 | United Kingdom . |

*Primary Examiner*—Jacob K. Ackun, Jr.
*Attorney, Agent, or Firm*—Thomas I. Rozsa; Tony D. Chen

[57] ABSTRACT

The present invention includes a portable vehicle adhesive remover having a motor unit and an eraser unit which includes a resilient eraser member and a disc member embedded in the eraser member. When the high speed rotating eraser member is engaged to pinstripes, decals, side moldings and other adhered items, it can generate adequate heat to cause the adhesive to lose its adhesion and thus release the pinstripes, decals, side moldings and other adhered items, so they can be removed without damaging the paint or other body parts of the vehicle. The present invention also includes a portable preparation tool kit for automobile body work and the like. The tool kit includes a case, a rotary pneumatic motor with accessories, a various different sized abrasive tools, and different shaped and sized sand tools. All of the abrasive and sand tools can be interchangeably connected to and driven by the rotary pneumatic motor. The tool kit contains a complete set of tools needed for preparing the body surface of an automobile or the like for further repairing, painting, decoration or other services.

18 Claims, 6 Drawing Sheets

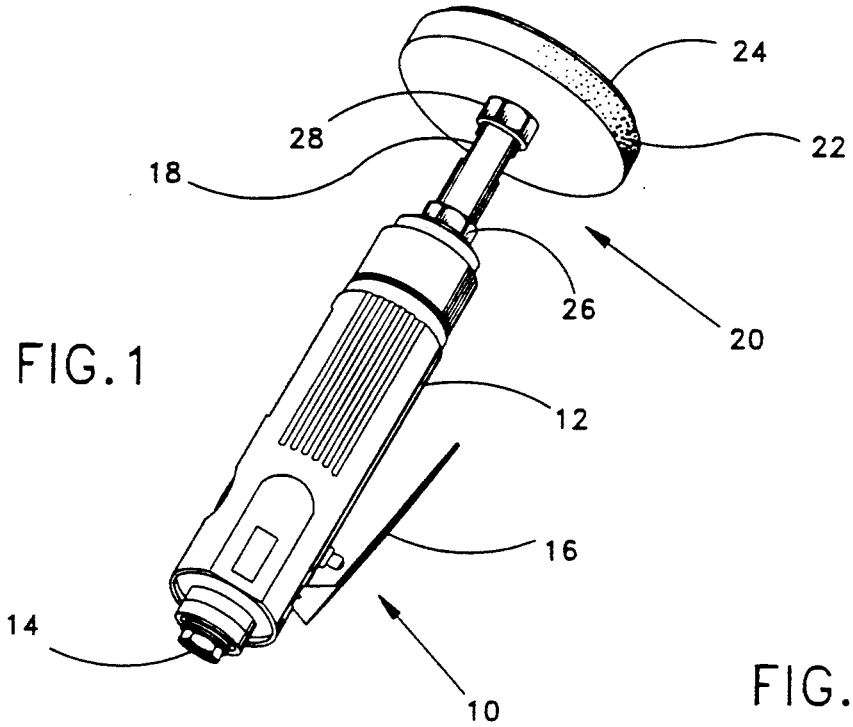
FIG. 1
FIG. 3
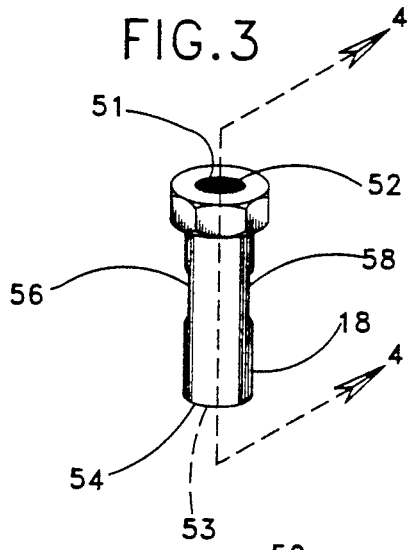
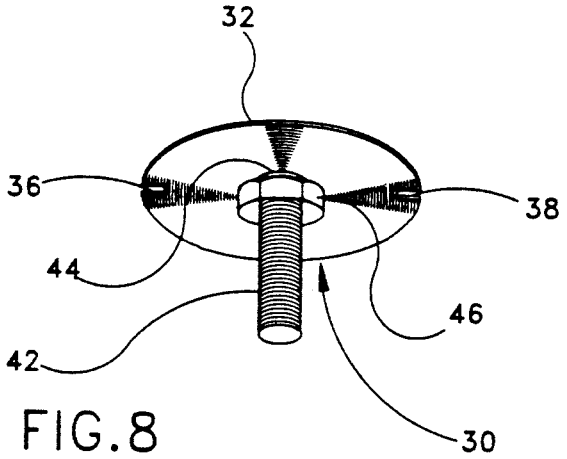
FIG. 8
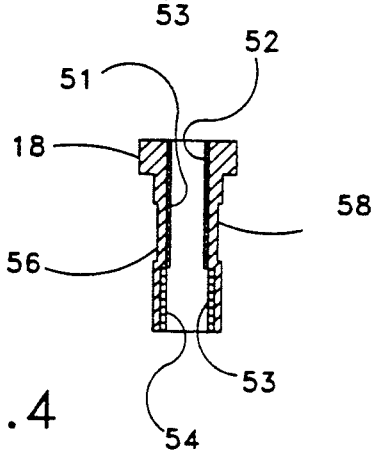
FIG. 4
Section on line 4 – 4

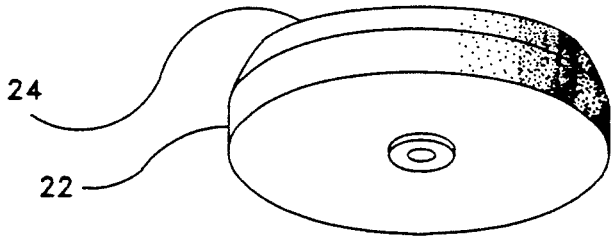
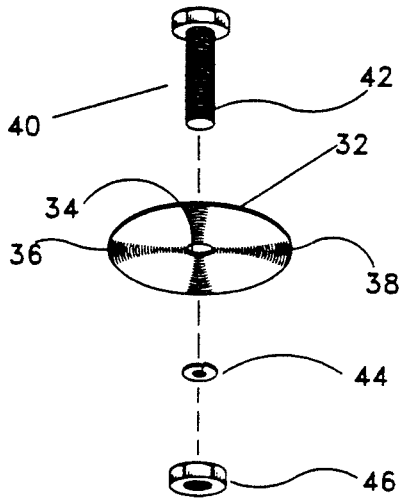
FIG.6
FIG.5
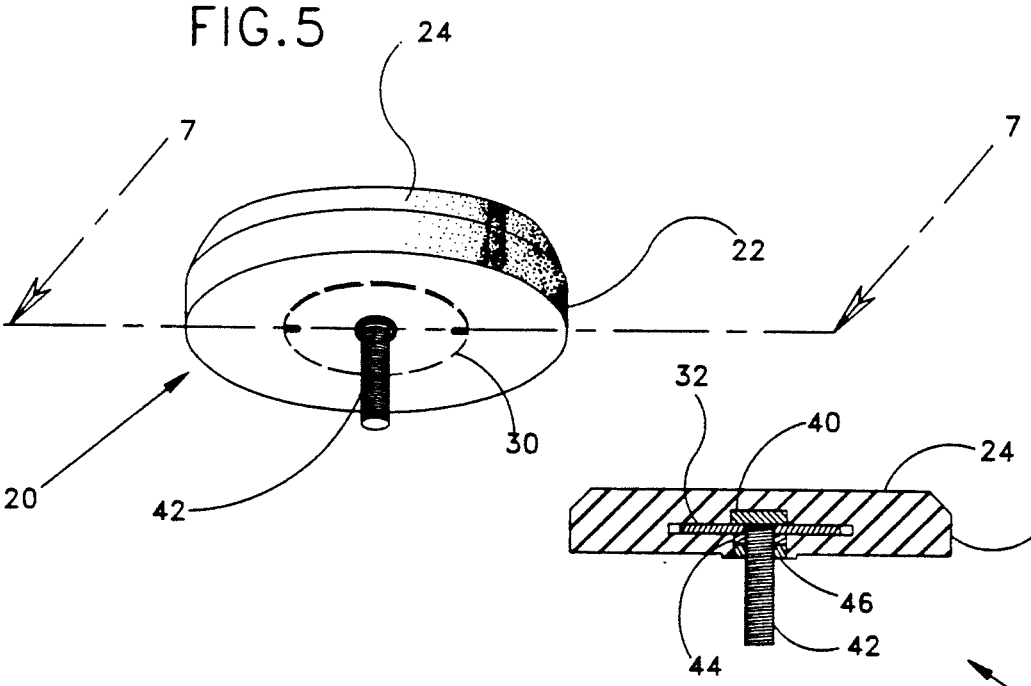
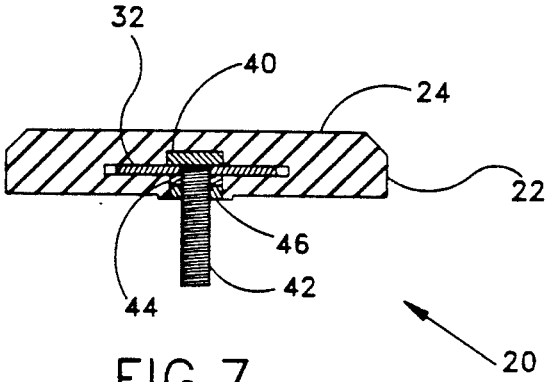
FIG.7
Section on line 7 – 7

FIG.9
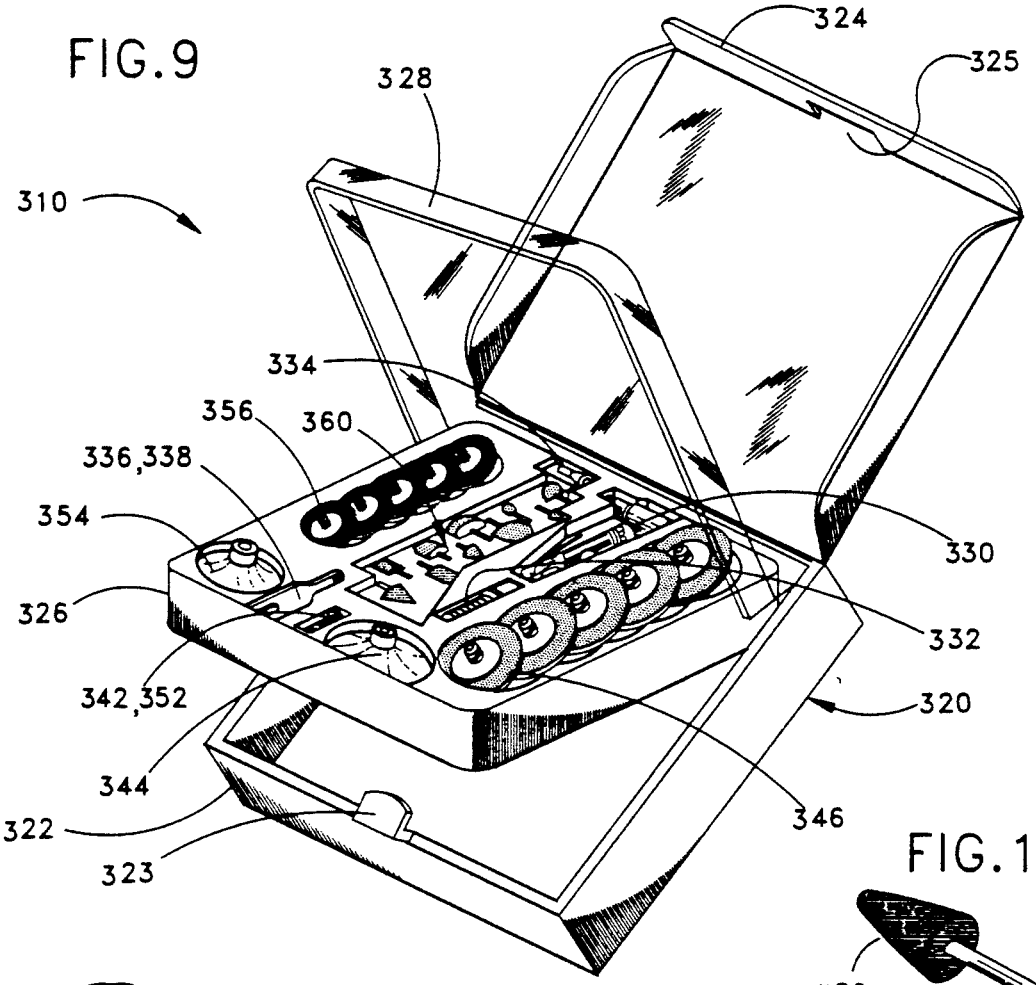
FIG.13
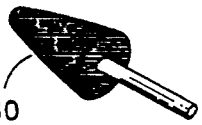
FIG.14
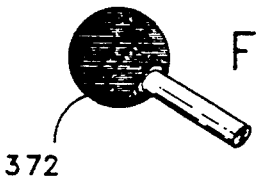
FIG.15
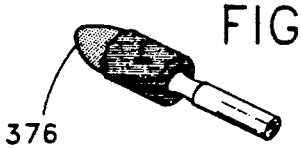
FIG.16
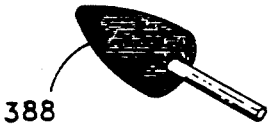
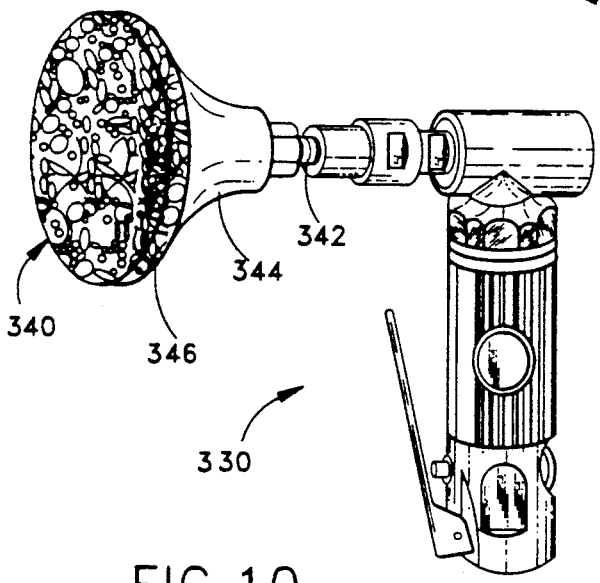
FIG.10

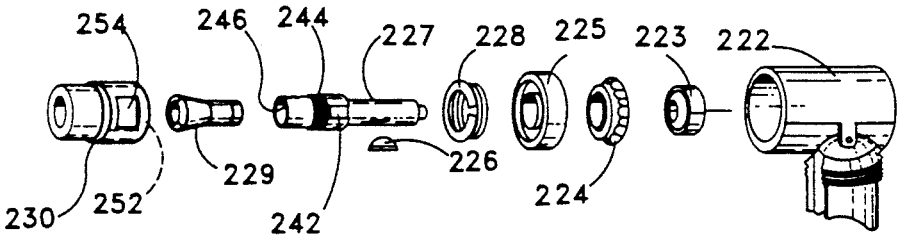

| INDEX | DESCRIPTION | QTY |
|---|---|---|
| 201 | Motor Housing | 1 |
| 202 | Throttle Valve | 1 |
| 203 | Throttle Valve Spring | 1 |
| 204 | Air Regulator | 1 |
| 205 | Regulator O-Ring | 1 |
| 206 | Valve Screw O-Ring | 1 |
| 207 | Valve Screw | 1 |
| 208 | Throttle Lever | 1 |
| 209 | Throttle Lever Pin | 1 |
| 210 | Rear Rotor Ball Bearing | 1 |
| 211 | Rear End Plato | 1 |
| 212 | Dowal Pin | 2 |
| 213 | Rotor Collar | 1 |
| 214 | Cylinder | 1 |
| 215 | Rotor | 1 |
| 216 | Rotor Blade | 4 |
| 217 | Front End Plate | 1 |
| 218 | Front Rotor Ball Bearing | 1 |
| 219 | Pinion | 1 |
| 220 | Motor Clamp | 1 |
| 221 | Housing Lock Ring | 1 |
| 222 | Angle Head Housing | 1 |
| 223 | Rear Spindle Ball Bearing | 1 |
| 224 | Spindle Gear | 1 |
| 225 | Front Spindle Ball Bearing | 1 |
| 226 | Woodruff Key | 1 |
| 227 | Spindle | 1 |
| 228 | Clamp Nut | 1 |
| 229 | Collet | 1 |
| 230 | Collet Nut | 1 |
| 231 | Throttle Valve Bushing | 1 |
| 232 | Throttle Valve O-Ring | 1 |
| 336 | Spindle Wrench | 1 |

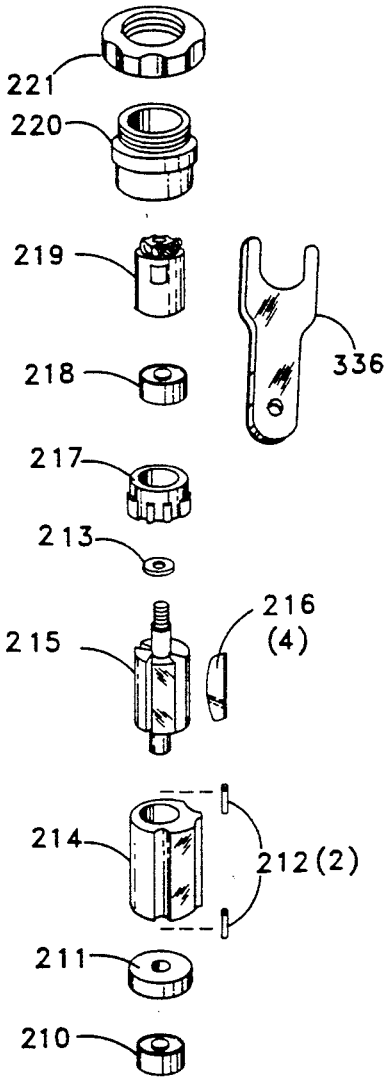

FIG. 11

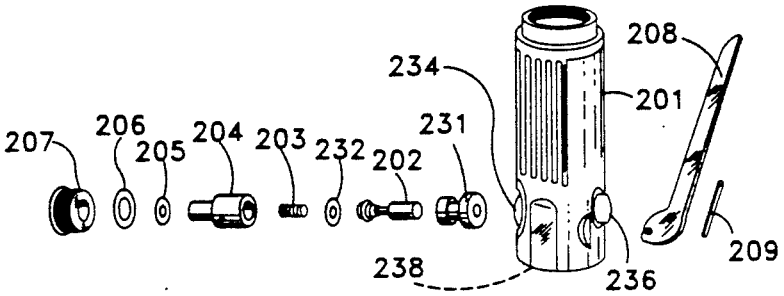

PORTABLE PREPARATION TOOL KIT FOR AUTOMOBILE BODY WORK

This is a continuation-in-part of copending application Ser. No. 07/719,948 filed on Jun. 24, 1991 now U.S. Pat. No. 5,259,914.

BACKGROUND OF THE INVENTION

1. Field of the Invention

The present invention relates to the automobile and other vehicle manufacture and service industries. More particularly, the present invention relates to portable power tools designed and built for removing vehicle adhesive to remove pinstripes, decals, side moldings and other adhered items from a vehicle.

The present invention also relates to the field of automobile body work. More particularly, the present invention also relates to portable preparation tools used for preparing an automobile body for repairing, painting, decoration or other services. 2. Description of the Prior Art In automobile and other vehicle manufacture and service industries, people often need to remove pinstripes, decals, side moldings and other adhered items from the bodies of vehicles such as trucks or automobiles. Traditionally it is done by peeling, scratching or sanding off the pinstripes, decals, side moldings, etc. However, these traditional methods usually damage the original paint on the bodies of the vehicles.

There is a significant need for an improved method to remove the pinstripes, decals, side moldings and other adhered items from a vehicle without damaging the paint on the vehicle.

In addition, in automobile and other vehicle manufacture and service industries, people often need to prepare the surface of automobile bodies for further vehicle body work, such as repairing, painting or decoration. Various portable tools are used for preparing automobile body surfaces. Typical automobile surface or body work preparation tools include rotary tools, such as and electric or pneumatic motor, and abrasive wheels, sand stones, etc., which can be attached to the rotatable tools.

The following seventeen (17) prior art references are relevant to portable automobile body work preparation tools or related devices.

1. U.S. Pat. No. 856,323 issued to Wickes on Jun. 11, 1907 for "Apparatus For Removing Labels From Records For Talking Machines" (hereafter "the Wickes Patent").

2. U.S. Pat. No. 2,545,453 issued to Forss on Mar. 20, 1951 for "Rotary Pneumatic Tool" (hereafter "the Forss Patent").

3. U.S. Pat. No. 2,570,009 issued to Schmid on Oct. 2, 1951 for "Throttle Valve For Fluid Actuated Rotary Tools" (hereafter "the Schmid Patent").

4. U.S. Pat. No. 2,607,232 issued to Haase on Aug. 19, 1952 for "Utility Appliance" (hereafter "the Haase Patent").

5. U.S. Pat. No. 2,854,286 issued to Salick on Sep. 30, 1958 for "Method Of Manufacture Of Buffing Disk And Bonnets" (hereafter "the Salick Patent").

6. U.S. Pat. No. 3,104,569 issued to Davis et al. on Sep. 24, 1963 for "Stud Bolt Remover" (hereafter "the Davis Patent").

7. U.S. Pat. No. 4,150,955 issued to Samuelson on Apr. 24, 1979 for "Deformable Non-Cellular Polyurethane Polishing Wheel" (hereinafter "the Samuelson Patent").

8. U.S. Pat. No. 4,197,061 issued to Hill on Apr. 8, 1980 for "Rotary Pneumatic Vane Motor With Rotatable Tubing Contracted By Vanes" (hereinafter "the Hill Patent").

9. U.S. Pat. No. 4,629,374 issued to Berner on Dec. 16, 1989 for "Boring Tool With Cutting Edge Adjustment For Withdrawal Clearance" (hereafter "the Berner Patent").

10. U.S. Pat. No. 4,690,724 issued to Outlaw on Sep. 1, 1987 for "Electrically Heated Decal Stripping Tool" (hereafter "the Outlaw Patent").

11. U.S. Pat. No. 4,866,319 issued to Crutchfield on Sep. 12, 1989 for "Erasing Machine" (hereafter "the Crutchfield Patent").

12. U.S. Pat. No. 5,005,807 issued to Mathews et al. on Apr. 9, 1991 for "Extension Bar For Blast Furnace Tap Hole Drill" (hereafter "the Mathews Patent").

13. U.S. Pat. No. 5,042,207 issued to Kirn on Aug. 27, 1991 for "Clamping Device For Axially Tightening A Tool, In Particular A Disc" (hereafter "the Kirn Patent").

14. U.S. Pat. No. 5,190,620 issued to Winter on Mar. 2, 1993 for "Method Of Using A Rotatable Disc To Remove Heat Softenable Surface Coverings" (hereafter "the Winter Patent").

15. Great Britain Patent No. 2,084,059 issued to McGarry on Apr. 7, 1982 for "Sanding Attachment For A Patent Tool" (hereafter "the McGarry Patent").

16. Great Britain Patent No. 2,114,925 issued to Karwacki on Sep. 1, 1983 for "Work-head And A Power Device Including Such A Work-Head" (hereafter "the Karwacki Patent").

17. German Patent No. 3,030,351 issued to Sprengel for "An Eraser Device" (hereafter "the German Patent").

The Wickes Patent discloses an apparatus for removing labels impressed into records. In includes a suitable base upon which a table is adapted to support the disk from which the label is to be removed.

The Forss Patent discloses a rotary pneumatic tool for grinding and rotary filing.

The Schmid Patent discloses a fluid actuated tool of the rotary type. It includes a cylindrical housing comprising a main portion and a rear portion capable of relative rotation.

The Haase Patent discloses a utility appliance for use around the home. It includes a motor, a frame, a flexible sheather driving cable and a supporting reel which is mounted on the frame. The reel is rotatable in one direction to extend the cable and rotatable reversely to retrieve the cable.

The Salick Patent discloses a method of manufacturing buffing disks and bonnets. The method utilizes a flexible or rigid form or core upon which is single and continuous strand of yarn, thread, fiber, wire, ribbon, or any combination is rapidly wound. The density of the strands in the disk is predeterminately controlled by the compactness of the winding of the strand on the form strip.

The Davis Patent discloses a drive for removing a stud bolt from a tapped bore. It includes a tubular member which is adapted to threadedly engage a stud bolt mounted in a tapped bore formed in a body, such as an engine block, or the like.

The Samuelson Patent discloses a deformable non-cellular polyurethane polishing wheel. The Samuelson device is a highly flexible, deformable polyurethane polishing or finishing wheel with a high density and suitable reinforcement to resist expansion under centrifugal force, where the wheel lasts at least 3 to 5 times as long as the spirally-wound finishing wheels.

The Hill Patent discloses a rotary pneumatic vane motor with rotatable tubing contacted by vanes. It includes a freely rotatable cylindrical shaped tubing located within the housing of a pneumatic motor, which forms the radial boundary of a drive chamber for the rotating vanes of a rotary seal vane type motor.

The Berner Patent discloses a boring tool which has a radially adjustable tool bit holder mounted on a head part which is connectable to an adaptor.

The Outlaw Patent discloses an electrically heated decal stripping tool. The tool includes a decal stripper attachment for a soldering iron. The decal stripping tool is adapted for the quick removal of adhesive decals from an automotive surface.

The Crutchfield Patent discloses a hand-held, motor driven erasing machine which operates directly from the nominal wall outlet voltage.

The Mathews Patent disclosed an extension bar for a blast furnace tap hole drill.

The Kirn Patent discloses a clamping device for portable grinding machines. The clamping device in part of a clamping nut, which is screwed on the threaded spindle portion of the drive spindle. The clamping nut carries a non-rotatable and axially displacement clamping disk.

The Winter Patent discloses a soft elastomeric disc for removing polymeric compositions from an underlying substrate. It includes a rotatable body comprising a peripheral surface and is rotatable about its axis.

The McGarry Patent discloses a sanding attachment for a power tool.

The Karwacki Patent discloses a work-head and a power device. The work-head includes a hard rubber base in which separate abrasive sanding sheets are attached.

The German Patent discloses a hand-held mechanical erasing device. It includes a housing with an on/off switch, a battery, a motor and an erasing wheel.

It can be seen that the tools disclosed in above prior art patents are all single purpose tools, each used only for performing a particular task. It is desirable to have a new portable preparation tool kit for automobile body work, which can be used for performing a series of tasks.

SUMMARY OF THE PRESENT INVENTION

The present invention is a portable vehicle adhesive remover for removing pinstripes, decals, side moldings and other adhered items from a vehicle without damaging the paint or other body parts of the vehicle.

It has been discovered according to the present invention, that if the adhesive used for holding pinstripes, decals, side moldings and other adhered items on the paint or other body parts of a vehicle is heated, then it will lose its adhesion and thus release the pinstripes, decals, side moldings and other adhered items from the vehicle without damaging the paint or other body parts of the vehicle.

It is also been discovered, according to the present invention, that if a vehicle adhesive remover having a circular eraser member rotating at high speed is engaged to the various adhered items on a vehicle, then the friction between the rotation eraser member and the adhered items can generat heat which in turn will warm up the adhesive and cause it to lose its adhesion.

It has further been discovered, according to the present invention, that if the high speed rotating eraser member of the vehicle adhesive remover is made of rubber type material, then it will most effectively generate heat when it is frictionally engaged to the adhered items on the body of the vehicle.

It is additionally been discovered, according to the present invention, that if the speed rotating rubber type eraser member of the vehicle adhesive eraser is rotating at a speed approximately between 3,000 rpm and 4,000 rpm, then the heat generated by its rotational engagement with the adhered items on the body of the vehicle is sufficient to cause the adhesive to substantially lose its adhesion and the adhered items will easily come off without damaging the paint on the vehicle.

It has also been discovered, according to the present invention, that if a specialized metal disc member attached to the rotation shaft of the motor unit is embedded into the rubber type erasing member of the vehicle adhesive remover, then the disc member can best prevent the rubber type erasing member from slipping relative to the rotation shank of the motor unit and can also easily replace worn out eraser members.

It has further been discovered, according to the present invention, that if the eraser unit of the vehicle adhesive remover is designed to be quickly detachable from the motor unit, then a user can use different sized erasers with one motor unit.

In has additionally been discovered, according to the present invention, that if the motor unit of the vehicle adhesive eraser has an air die motor, then it can utilize compressed air as its power source, which is a very popular and convenient power source for the tools used in the automobile manufacture and service industries.

It is therefore an object of the present invention to provide a vehicle adhesive remover, which can cause the adhesive used for adhering pinstripes, decals, side moldings and other adhered items on the paint of other body parts of a vehicle to lose its adhesion, so that the pinstripes, decals, side moldings and other adhered items can be removed from a vehicle without damaging the paint or other body parts of the vehicle.

It is also an object of the present invention to provide a vehicle adhesive remover, which has a circular eraser member rotating at high speed and engaged to the various adhered items on a vehicle, so that the friction between the rotating eraser member of the vehicle adhesive eraser and the adhered items on the vehicle can generate heat which in turn will warm up the adhesive and cause it to lose its adhesion.

It is a further object of the present invention to provide a vehicle adhesive eraser, where the high speed rotating eraser member of the vehicle adhesive remover is made of rubber type material, so that it will most effectively generate heat when it is frictionally engaged to the adhered items on the body of the vehicle.

It is an additional object of the present invention to provide a vehicle adhesive eraser, where the high speed rotating rubber type eraser member of the vehicle adhesive remover is rotating at a speed approximately between 3,000 rpm and 4,000 rpm. Then the heat generated by its rotational engagement with the adhered items on the body of the vehicle is sufficient to cause the adhesive to substantially lose its adhesion and the adhered items will easily come off without damaging the paint on the vehicle.

Its is also an object of the present invention to provide a vehicle adhesive eraser, where a specialized metal disc member attached to the rotation shaft of the motor unit is embedded into the rubber type erasing member of the vehicle adhesive remover, so that the disc member can best prevent the rubber type erasing member from slipping relative to the rotation shank of the motor unit.

It is a further object of the present invention to provide a vehicle adhesive eraser, where the eraser unit of the vehicle adhesive remover is designed to be quickly detachable from the motor unit. The a user can use different sized erasers with one motor unit can also easily replace worn out eraser members.

It is an additional object of the present invention to provide a vehicle adhesive remover, where the motor unit of the vehicle adhesive eraser has an air die motor, so that it can utilize compressed air as its power source, which is a very popular and convenient power source for the tools used in the automobile manufacture and service industries.

The present invention is also a portable preparation tool kit for automobile body work and the like.

In automobile and other service industries, it is often desirable to have a convenient preparation tool kit which includes every basic tool needed for preparing the body surface of an automobile of the like for further repairing, painting, decoration or other services. Conventional preparation tools used for automobile body work include electric or pneumatic motors, abrasive wheels, sand stones, etc. There are several problems with the conventional tools.

One of the problems with the conventional tools is that a user has to obtain the tools individually from separate sources, which is often very inconvenient. For example, a user has to get a rotary tool made by one manufacturer and an abrasive wheel from a different manufacturer, and sometimes the tools are not compatible with each other.

Another problem with the conventional tools is that it is often difficult to obtain a complete set of tools needed for necessary automobile body work. For example, different sized and shaped sand stones are often needed at different locations of the automobile body or used in different stages of the preparation. It is often inconvenient to collet these different sized and shaped sand stones completely either before or during the preparation work.

A further problem with the conventional tools is that they all have different specifications and are often impossible to be used interchangeably. For example, the stems of large or small sand stones often have different diameters, but a conventional rotary tool often comes with only one fixed sized collet which may not fit all different stems of large or small sand stones. All these problems in prior art have created a lot of inconvenience in automobile body work.

It has been discovered, according to the present invention, that if a portable preparation tool kit is provided for automobile body work and the like, which contains the basic tools such as a portable rotary tool, sand stones and abrasive wheels, then a user can have a complete set of tools needed for necessary automobile body work without the difficulty of finding and colleting these various tools from different sources.

It has also been discovered, according to the present invention, that if a portable preparation tool kit is provided for automobile body work and the like, which contains different sized or shaped sand stones and abrasive wheels, then a user can use these different sized or shaped tools at different locations of the automobile body or used in different stages of the preparation, without the trouble of looking for these different sized or shaped tools either before or during the preparation work.

It has further been discovered, according to the present invention, that if a portable preparation tool kit is provided for automobile body work and the like, which contains interchangeable collets for the portable rotary tool, then a user can use a single rotary tool to operate all sand stones and abrasive wheels with different specifications through the interchangeable collets, without the burden of getting several rotary tools.

It is therefore an object of the present invention to provide a portable preparation tool kit for automobile body work and the like, which contains the basic tools such as a portable rotary tool, sand stones and abrasive wheels, so that a user can have a complete set of tools needed for necessary automobile body work without the trouble of looking for these various tools from different sources.

It is also an object of the present invention to provide a portable preparation tool kit for automobile body work and the like, which contains different sized or shaped sand stones and abrasive wheels, so that a user can use these different sized or shaped tools at different locations of the automobile body or used in different stages of the preparation, without the difficulty of colleting these different sized or shaped tools either before or during the preparation work.

It is a further object of the present invention to provide a portable preparation tool kit for automobile body work and the like, which contains interchangeable collets for the portable rotary tool, so that a user can use only one rotary tool to operate all sand stones and abrasive wheels with different specifications through the interchangeable collets, without the need of having multiple rotary tools.

Described generally, the present invention is a portable preparation tool kit for automobile body work and the like. The tool kit includes a case, a rotary pneumatic motor with accessories, a various different sized abrasive tools, and different shaped and sized sand tools. All of the abrasive and sand tools can be interchangeably connected to and driven by the rotary pneumatic motor.

The present invention preparation tool kit provides a complete and collective set of tools most frequently used in small body work and is contained in a compact and portable package. All the various tools in the kit can be interchangeably adapted to one pneumatic motor which utilizes safe, convenient and harmless compressed air as its power source.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention portable vehicle adhesive remover having an air die grinder motor unit and a detachable eraser unit.

FIG. 3 is a perspective view of the extending shank of the present invention portable vehicle adhesive remover.

FIG. 4 is a cross-sectional view of the extending shank of the present invention portable vehicle adhesive remover taken along line 4—4 of FIG. 3.

FIG. 5 is a perspective view of the eraser unit of the present invention portable vehicle adhesive remover.

FIG. 6 is an exploded view of the eraser unit of the present invention portable vehicle adhesive remover.

FIG. 7 is a cross-sectional view of the eraser unit of the present invention portable vehicle adhesive remover taken along line 7—7 of FIG. 5.

FIG. 8 is a perspective view of the novel disc member of the eraser unit of the present invention portable vehicle adhesive remover.

FIG. 9 is a perspective view of the present invention portable preparation tool kit for automobile body work and the like.

FIG. 10 is a perspective view of the present invention, showing an abrasive wheel attached to an angle head rotary pneumatic motor.

FIG. 11 is an exploded view of the present invention angle head rotary pneumatic motor.

FIG. 13 is a perspective view of one of the sand stones of the present invention.

FIG. 14 is a perspective view of another one of the sand stones of the present invention.

FIG. 15 is a perspective view of still another one of the sand stones of the present invention.

FIG. 16 is a perspective view of again another one of the sand stones of the present invention.

DETAILED DESCRIPTION OF THE PREFERRED EMBODIMENT

Figure 2:
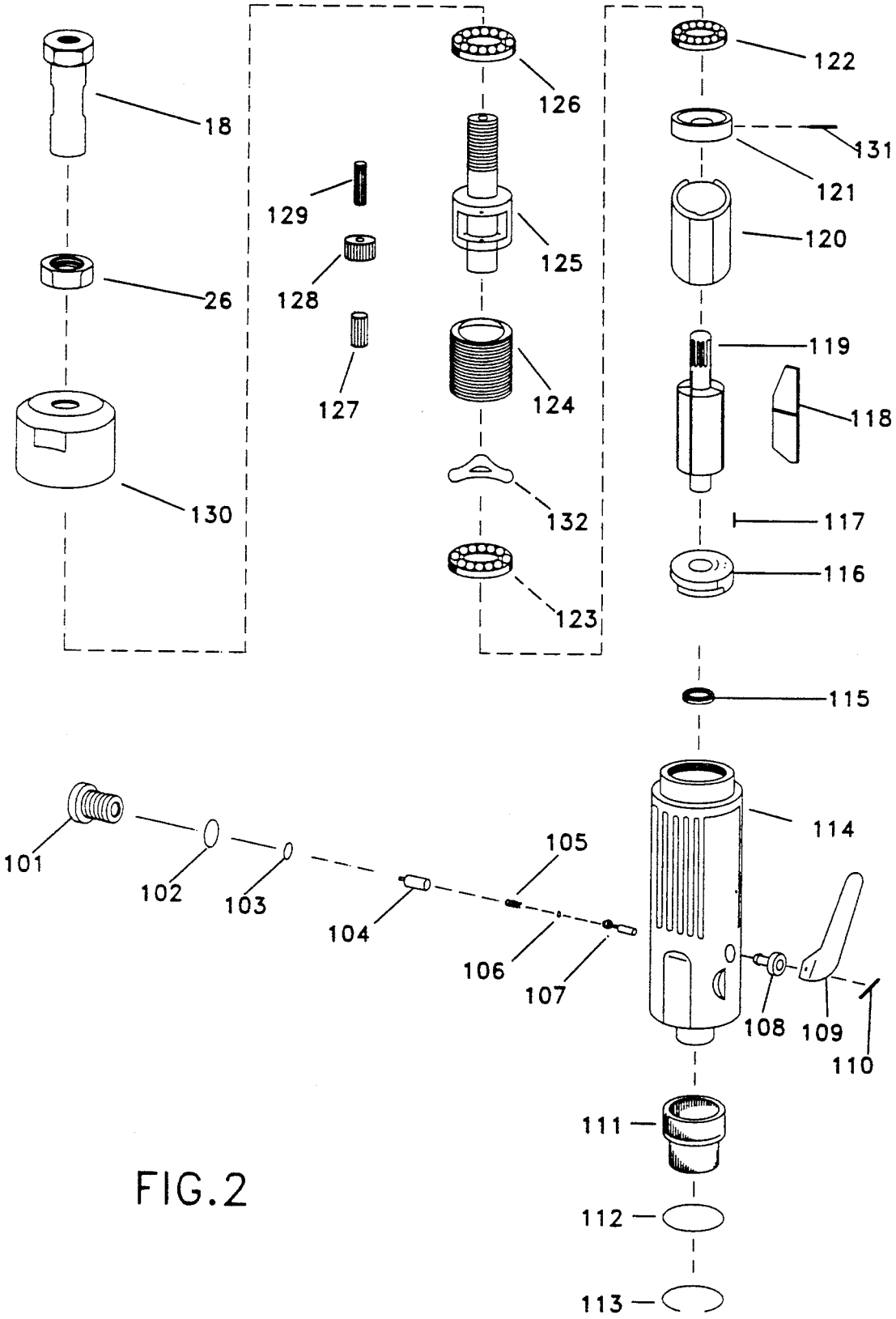
FIG. 2 is an exploded view of the motor unit of the present invention portable vehicle adhesive remover.

Although specific embodiments of the present invention will now be described with reference to the drawings, it should be understood that such embodiments are by way of example only and merely illustrative of but a small number of the many possible specific embodiments which can represent applications of the principle of the invention. Various changes and modifications obvious to one skilled in the art to which the invention pertains are deemed to be within the spirit, scope and contemplation of the invention as further defined in the appended claims.

Referring to FIG. 1, there is shown a perspective view of a portable vehicle adhesive remover 10. It has a motor unit 12 which has an air exhaust port 14 and a throttle control lever 16 at the bottom end, and a rotatable extending shank 18 at the top end. An eraser unit 20 is detachably attached to rotatable shank 18. Eraser unit 20 has a disc shaped rubber eraser member 22 having a flat transverse erasing surface 24. Rotatable extending shank 18 may be detached by using pliers to hold both the nut 26 of motor unit 12 and the nut 28 of extending shank 18 and then turn them in opposite directions. Eraser unit 20 can be detached by holding rubber eraser member 22 by hand and holding top nut 28 of extending shank 18 with a pair of pliers and then turning them in opposite directions.

Referring to FIG. 2, there is shown an exploded view of motor unit 12 of portable vehicle adhesive remover 10. Motor unit 12 has a hollow cylindrical housing 114. Near the bottom end of housing 114 there are two opposite side openings and one bottom opening. An air exhaust sleeve 111 is attached to the bottom opening with an "O" ring 112 and a retainer ring 113 inserted. A throttler assembly is assembled inside the bottom portion of housing 114, a rotor assembly is assembled inside the middle portion of housing 114, and a gear assembly is assembled inside the top portion of housing 114.

The throttler assembly includes an air regulator 104, a valve stem 107 and a valve bushing 108. One end of valve stem 107 is inserted with a spring 105 into air regulator 104 with an "O" ring 106, so that spring 105 tends to push valve stem 107 out to block the air passage through air regulator 104. The other end of valve stem 107 is stuck out from one of the side openings through valve bushing 108 which is in turn mounted on the side of housing 114 at the side opening. Air regulator 104 is assembled inside housing 114 and supported by a valve screw 101 with an "O" ring 103 inserted which is in turn mounted on the side of housing 114 at the other opposite side opening with an "O" ring 102 inserted. A throttle lever 109 is attached by a roll pin 110 to the side of housing 114 near the bottom end against the stuck out end of valve stem 107.

The rotor assembly includes a cylinder 120 and a rotor 119 which has four side slots with blades 118 mounted respectively. Rotor 119 is supported by front ball bearing 122 and rear ball bearing 115 and assembled inside cylinder 120. Front end plate 121 and rear end plate 116 are assembled to the respective ends of cylinder 120 by two roll pins 131 and 117 respectively.

The gear assembly includes an internal gear 124 and a planet cage 125 which has two side slots with planet gears 128 mounted respectively by planet pins 129. Planet cage 125 is supported by two ball bearings 126 and 123 and assembled inside internal gear 124 with a wave washer 132 and two idle gears bushings 127 engaged with the two planet gears 128 respectively.

Finally, a housing cap 130 is screwed on top of housing 114 and the upper shaft of the planet cage sticks out from the top opening of housing cap 130 for receiving a cap nut 26 and a hollow extending shank. Shown in detail in FIGS. 3 and 4, extending shank 18 has inner screw threads 51 and 53 at its upper end 52 and lower end 54 respectively. The inner screw threads 51 at upper end 52 of extending shank 18 receive the eraser unit shown in FIG. 5. Lower end 54 of extending shank 18 is threaded onto the stuck out upper shaft of planet cage 125 of the gear assembly by lower threads 53. The outer periphery of the upper end of extending shank 18 is configured as a nut 28 for accommodating a pair of pliers. The outer periphery of the middle portion of the extending shank is also configured to have two oppositely disposed flat surfaces 56 and 58 for accommodating a pair of pliers.

Referring now to FIGS. 5-8, there is shown the eraser unit 20 of the present invention portable vehicle adhesive remover 10. FIG. 5 is a perspective view of eraser unit 20, FIG. 6 is an exploded view of eraser unit 20, FIG. 7 is a cross-sectional view of eraser unit 20 taken along line 7—7 of FIG. 5, and FIG. 8 is a perspective view of the novel disc member of eraser unit 20.

Eraser unit 20 has a disc-shaped rubber eraser member 22 having a flat top erasing surface 24, and a disc member 30 embedded inside eraser member 22. Disc member 30 includes a disc 32 having a central opening 34 and two rim notches 36 and 38, a bolt 40 having an elongated shaft 42, a washer 44 and a nut 46. The elongated shaft 42 of bolt 40 extends through the central opening 34 of disc 32 and is secured by nut 46 with washer 44 inserted. When molding the rubber eraser member 22 with the disc member embedded, the rubber material will fill in the two rim notches 36 and 38 of disc 30, so that rubber eraser member 22 will not slip relative to disc 30 during rotational motion. After molding, only the elongated shaft 42 of bolt 40 is exposed out of rubber eraser member 22, which is in turn engaged with the upper end 52 of extending shank 28 of motor unit 12.

When high pressure compressed air is sent into the bottom end 14 of motor unit 12 and throttle control lever 16 is pressed, the compressed air will be gushed into the rotor assembly through the throttler assembly and blow blades 118 to make rotor 119 rotate, which in turn drives extending shank 18 to rotate through the gear assembly. Consequently rubber eraser member 22 is rotated by embedded disc member 30, and its erasing surface 24 can be engaged to pinstripes, decals, side moldings and other adhered items on vehicle bodies. By using pliers eraser unit 20 can be detached from motor unit 12, which enables a user to use alternative eraser units having different sized erasing surfaces with one motor unit. When the rubber erasing member is engaged to the vehicle pinstripes or decals or the adhesive holding side molding to a vehicle, the high velocity rotation of the rubber erasing member will generate adequate heat to cause the vehicle adhesive to lose its adhesion and thus release the pinstripes, decals, side moldings and other adhered items, so the pinstripes, decals, side moldings and other adhered items can be removed by the rubber erasing member without damaging the paint or other body parts of the vehicle.

Like any standard rubber eraser, the rubber portion of the eraser member of the present invention vehicle adhesive remover will be used up in extensive usage. However, as the rubber portion of the rubber erasing member is worn out, the whole eraser unit 20 can be easily detached from the motor unit 12 and be replaced. Preferably the rubber material of the eraser member is 45 in hardness, and the disc shaped rubber member is three and one-half inches in diameter.

The novel feature of the present invention portable remover is that, unlike the conventional tools designed for removing the pinstripes, decals, side moldings and other adhered items, the present invention remover does not remove the pinstripes, decals, side moldings and other adhered items ty physically deteriorating, destroying or disintegrating them which often results in damaging the original paint or other body parts of the vehicle, but rather removes the pinstripes, decals, side moldings and other adhered items by using a high speed rotating rubber eraser to generate adequate heat to cause the adhesive to lose its adhesion and thus release the pinstripes, decals, side moldings and other adhered items, so they will come off without damaging the paint or other body parts of the vehicle.

The present invention vehicle adhesive remover can be used to remove anything adhered onto the vehicle by vehicle adhesives. As mentioned above, it can be used to remove pinstripes, decals, side moldings, etc. Sometimes when a side molding is pulled off a vehicle, it was held on by a two-sided adhesive. The present invention adhesive remover can also effectively remove this type of two-sided adhesive. In addition, the present invention vehicle adhesive remover can be used to remove other items adhered on various parts of the body of a vehicle, such as factory stickers adhered on certain parts of the vehicle, or price tickets and advertising slips adhered on the glass windows of the vehicle.

The present invention adhesive remover has many advantages including: (a) it uses safe, convenient and harmless compressed air as its power source; (b) it is a light and small portable device; (c) it increases the speed of the process of removing various adhered items of a vehicle, yet reduces its difficulty; (d) it leaves no damage on the original paint or body part of the vehicles; and (e) the eraser unit is detachable so different sized eraser units may be used with a common motor unit.

Further referring to FIG. 9, there is shown a perspective view of the present invention portable preparation tool kit 310 for automobile body work and the like. The portable preparation tool kit 310 is contained in a case 320, which includes a box 322, a lid 324, a recessed panel 326 and a dust cover 328. The box 322 and the lid 324 may be made of an integral piece of folded cardboard or the like. The box 323 has a small front flap 323 which can be inserted into a small front slit 325 in the lid 324 for locking them together when the lid 324 is closed onto the box 322. The recessed panel has various recesses with different shapes and depths for retaining the various components of the preparation kit 310. The recessed panel 326 may be made of molded plastic or simply of cardboard. The dust cover 328 is preferably made of transparent plastic material so that a user can view the contents of the kit once the lid 324 is opened.

In one of the preferred embodiments of the present invention, the components of the portable preparation tool kit 310 include three types of tools: (1) a portable rotary tool; (2) abrasive tools; and (3) sand tools. The components of the tool kit 310 also include accessories for interconnecting and interchanging the various tools.

The portable rotary tool is an angle head rotary pneumatic motor 330. The accessories for the pneumatic motor 330 includes an alternative collet 332, an air hose adaptor 334, a spindle wrench 336, and a collect nut wrench 338. The usage of the accessories will be described later.

The abrasive tools include a large abrasive tool set and a small abrasive tool set. The large abrasive tool set includes an elongated shaft 342, a large abrasive wheel base 344, and ten (10) large abrasive wheels 346. The small abrasive tool set includes an elongated shaft 352, a small abrasive wheel base 354, and ten (10) small abrasive wheels 356. Of course the dimension and quantity of the abrasive wheels may vary to suit specific purposes.

The sand tools include ten (10) sand stones 360, which can be divided into a large sand tool set and a small sand tool set. The large sand tool set (illustrated in detail in FIG. 12) includes a large conical sand stone 370, a large spherical sand stone 372 (see FIG. 14), a large cylindrical sand stone 374, a large round tipped cylindrical sand stone 376 (see FIG. 15), and a large sharp tipped cylindrical sand stone 378. The small sand tool set includes a small conical sand stone 380 (see FIG. 13), a small spherical sand stone 382, a small cylindrical sand stone 384, a small round tipped cylindrical sand stone 386, and a small sharp tipped cylindrical sand stone 388 (see FIG. 16). Detailed configurations of the ten (10 ) large and small sand stones 360 are shown in FIGS. 12 through 16. Of course the shape, dimension and quantity of the sand stones 360 may vary to suit specific purposes.

Referring to FIG. 10, there is shown how the present invention preparation tool is assembled and ready for use in automobile body work or the like. FIG. 10 shows as an example a large abrasive wheel 346 attached to the angle head rotary pneumatic motor 330. The small abrasive wheels 356 and sand stones 360 may also be attached interchangeably to the pneumatic motor 330 in a similar manner, as shown in detail in FIG. 12.

Referring to FIG. 11, there is shown the detailed design and construction of the present invention angle head rotary pneumatic motor 330. The pneumatic motor 330 includes a housing assembly, a throttler assembly, a rotor assembly, a spindle assembly, and a collet assembly.

The housing assembly includes a main housing 201, a locking ring 221, and an angle head housing 222. The main housing 201 is hollow cylindrical shaped and houses the throttler assembly and the rotor assembly, and the angle head housing 222 houses the spindle assembly and the collet assembly. The angle head housing 222 is attached to the top of main housing 201 by the locking ring 221. At the bottom of main housing 201 there are two opposite side openings 234 and 236 for accommodating the throttler assembly and a bottom port 238 for receiving compressed air.

The throttler assembly is assembled inside the lower portion of the main housing 201. The throttler assembly includes a valve bushing 231, a valve O-ring 232, a valve 202, a valve spring 203, an air regulator 204, a regulator "O" ring 205, a valve screw "O" ring 206, a valve screw 207, a lever 208, and a roll pin 209. The valve bushing 231 is mounted to the main housing 201 at the side opening 236. One end of the valve 202 is inserted with the valve spring 203 into the air regulator 204 with the valve "O" ring 232, so that the the valve spring 203 tends to push the valve 202 out to block the air passage through air regulator 204. The other end of the valve 202 is stuck out from the side opening 236 through valve bushing 231. The air regulator 204 is located inside main housing 201 and supported by the valve screw 207 with the regulator "O" ring 205 inserted. The valve screw is mounted to the main housing 201 at the opposite side opening 234 with the valve screw "O" ring 206 inserted. The lever 208 is pivotally attached by the roll pin 209 to the bottom of main housing 201 adjacent to the side opening 236 against the stuck out end of the valve 202, so that the valve 202 is pressed inwardly to allow air passage through the air regulator 204 when the lever 208 is held towards the main housing 201.

The rotor assembly is assembled inside the upper portion of the main housing 201. The rotor assembly includes a lower ball bearing 210, a lower plate 211, two (2) dowel pins 212, a rotor cylinder 214, a rotor 215 with four (4) rotor blades 216, a rotor collar 213, an upper plate 217, an upper ball bearing 218, a pinion 219, and a motor camp 220. The rotor 215 and rotor blades 216 are located inside the rotor cylinder 214 and supported by the lower ball bearing 210 and upper ball bearing 218. The lower plate 211 and upper plate 217 are attached to the respective ends of the rotor cylinder 214 by the two dowel pins 212 respectively. The pinion 219 is attached to the rotor 215. The motor camp 220 is mounted to the top of the main housing 201. The angle head housing 222 is then mounted to the top of the main housing 201 by locking ring 221, where the top end of the pinion 219 extends into the angle head housing 222.

The spindle assembly is assembled inside the angle head housing 222. The spindle assembly includes a rear ball bearing 223, a gear 224, a front ball bearing 225, a spindle 227 with a key 226, and a clamp nut 228. The spindle 227 is engaged with the gear 224 through the key 226, and supported by the rear ball bearing 223 and front ball bearing 225. The gear 224 is engaged with the pinion 219 of the rotor assembly for transmitting the rotation. The spindle assembly is secured inside the angle head housing 222 by the clamp nut 228, with the front portion of the spindle 227 extending out of the angle head housing 222. The front portion of the spindle 227 has outer screw threads 224 for fastening a collet nut. The front portion of the spindle 227 also has two opposite flat surfaces 242 for adapting the spindle wrench 336, so that the user can use the spindle wrench 336 to turn the spindle 227 for facilitating the tightening or loosening the collet nut. The front portion of the spindle 227 further has an inner chamber 246 for retaining a collet.

The collet assembly includes a collet 229 and a collet nut 230. The collet 229 is retained within the inner chamber 246 of the spindle. The collet nut 230 has inner screws 252 so it can be fastened onto the front portion of the spindle 227 for tightening the collet 229. The collect nut 230 also has two opposite flat surfaces 254 for adapting the collet nut wrench 338, so that the user can use the collet nut wrench 338 to turn the collet nut 230 for tightening or loosening of the collet 229.

When high pressure compressed air is sent into the bottom port 238 of the main housing 201 and the lever 208 is pressed, the compressed air will be gushed into the rotor assembly through the throttler assembly and blow the rotor blades 216 to make the rotor 215 rotate. The rotation is transmitted to the spindle 227 through the pinion 219 and the gear 224, which in turn drives the preparation tool such as an abrasive wheel or a sand stone through the collet assembly.

Figure 12:
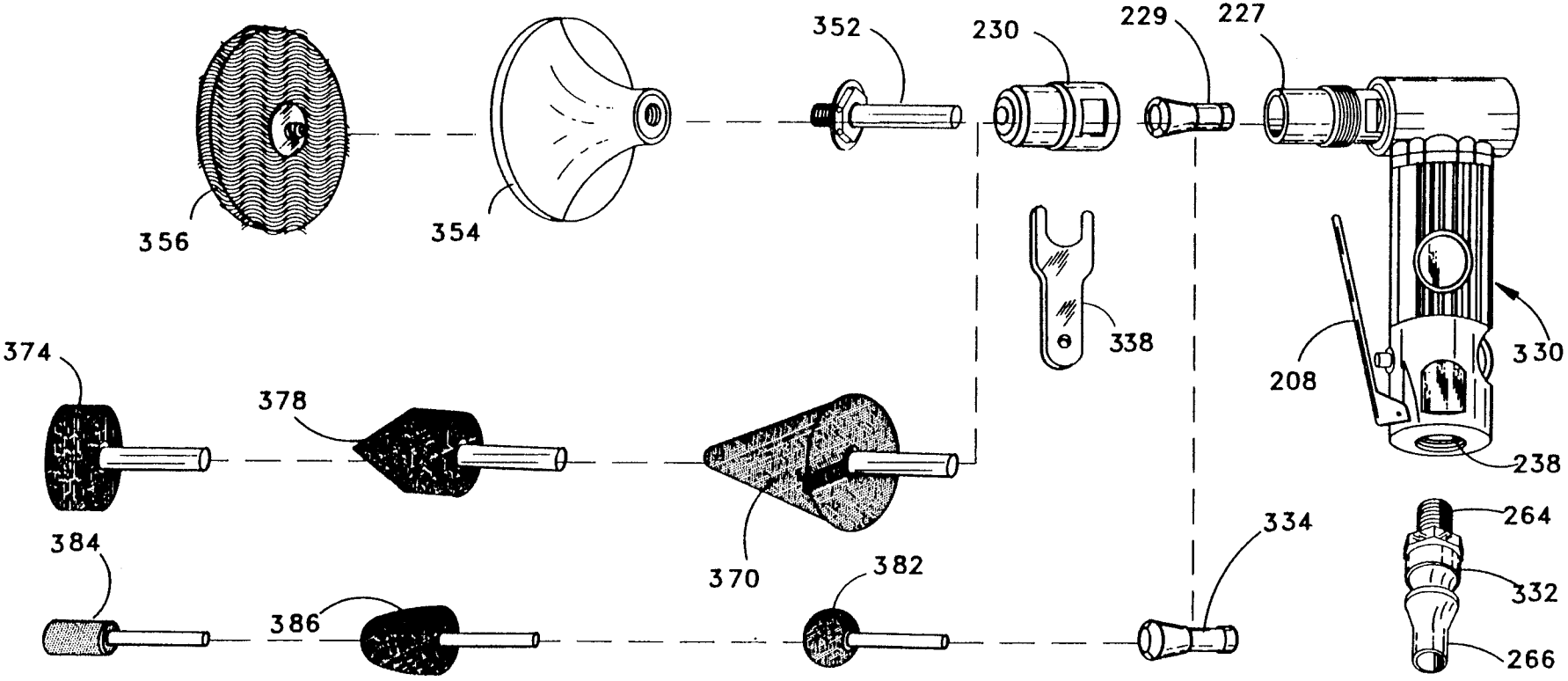
FIG. 12 is an exploded view showing the interchangeability of the present invention preparation tool kit.

The completeness and interchangeability of the present invention preparation tool kit 310 is illustrated in FIG. 12. The air hose adapter 334 can be attached to the bottom of the main housing 201 at the bottom port 238. The original collet 229 has a larger inner bore and is used with the abrasive wheels and large sand stones. FIG. 12 shows as an example that a small abrasive wheel 356 is fastened onto the small abrasive wheel base 354, which is in turn fastened to the elongated shaft 352. The elongated shaft 352 is then attached to the collet 229 and fastened thereon by the collet nut 230 by using the collect nut wrench 338. Since the elongated shaft 342 for the large abrasive wheel base 344 is identical with the elongated shaft 352 for the small abrasive wheel base 354, a large abrasive wheel can be attached to the pneumatic motor 330 in similar manner, as previously shown in FIG. 10. Once an abrasive wheel is worn out, it can be removed from the abrasive wheel base and simply replaced by another one of the abrasive wheels.

Referring again to FIG. 12, the stems of the large sand stones, such as the large conical sand stone 370, have an identical outer diameter as that of the elongated shaft 352 for the abrasive wheels. Therefore, the original collet 229 can also be used for connecting the large sand tool set to the pneumatic motor 330. In other words, the original collet 229 can be used for interchangeably connecting either the large or small abrasive wheels, or the large sand stone set, including the large conical sand stone 370, the large cylindrical sand stone 374 and the large sharp tipped cylindrical sand stone 378 shown in FIG. 12, the large spherical sand stone 372 shown in FIG. 14, and the large round tipped cylindrical sand stone 376 as shown in FIG. 15.

However, the stems of the small sand stones, such as the small spherical sand stone 382, have a smaller outer diameter than that of the elongated shaft 352 for abrasive wheels or the stems of the large sand stones. Therefore, the original collet 229 cannot be used for connecting the small sand tool set to the pneumatic motor 330. Accordingly, the alternative collet 332 is provided for connecting the small sand tool set to the pneumatic motor 330. The alternative collet 332 has a smaller inner bore which is suitable for the thinner stems of the small sand stones. In other words, the alternative collet 332 is provided for interchangeably connecting the small sand tool set, including the small spherical sand stone 382, the small cylindrical sand stone 384 and the small round tipped cylindrical sand stone 386 shown in FIG. 12, the small conical sand stone 380 shown in FIG. 13, and the small sharped tipped cylindrical sand stone 388 shown in FIG. 16.

The different shapes and sizes of the sand stone of the present invention tool kit are provided for working on different surfaces at different locations of the automobile bodies. In addition, the sand stones may also have different hardness to suit various needs. The hardness of the sand may be represented by the color of the sand stones.

The present invention preparation kit for automobile body work or the like has many advantages, including: (a) it is contained in a compact and portable package; (b) it provides a complete and collective set of tools most frequently used in small body work; (c) all the various tools in the kit can be interchangeably adapted to one pneumatic motor; and (d) it utilizes safe, convenient and harmless compressed air as its power source.

Defined in detail, the present invention is a portable vehicle adhesive remover comprising: (a) a generally cylindrical shaped hollow housing having a top end with a top opening, a bottom end with a bottom opening, a middle portion, a first side opening and an opposite second side opening adjacent to the bottom end; (b) an air exhaust sleeve mounted to said bottom end of said housing at said bottom opening with a first "O" ring and a retainer ring inserted; (c) a throttler assembly assembled inside said housing adjacent to its said bottom end including an air regulator, a valve stem having an inner end and an outer end, and a valve bushing, where the air regulator is supported by valve screw with a third "O" ring inserted, which valve screw is in turn mounted on said housing at its said first side opening with a second "O" ring inserted, the inner end of the valve stem is inserted with a spring into the air regulator with a fourth "O" ring inserted, so that the spring tends to push the valve stem out to block air passage through the air regulator, and the outer end of the valve stem extends out from said second side opening of said housing through the valve bushing which is in turn mounted on said housing at its said second side opening; (d) a throttle lever pivotally mounted to said housing adjacent to its said bottom end by a first roll pin and against the extended outer end of said valve stem of said throttler assembly, such that when the throttle lever is pressed, said valve stem of said throttler assembly is pressed into said air regulator of said throttler assembly to permit air passage; (e) a rotor assembly assembled inside said middle portion of said housing including a cylinder having a front end and a rear end, a rotor with four rotor blades, a first ball bearing, a second ball bearing, a front end plate and a rear end plate, where the rotor and the rotor blades are assembled inside the cylinder and supported by the first and second ball bearings, and the front and rear end plates are attached to the front and rear ends of the cylinder by a second roll pin and a third roll pin respectively; (f) a gear assembly assembled inside said housing adjacent to its said top end including an internal gear, a planet cage having an elongated spindle, two planet gears mounted to the planet cage by two planet pins respectively, two idle gear bushings, a third ball bearing, a fourth ball bearing and a fastening nut, where the planet cage with the two planet gears and two idle gear bushings are engaged with the internal gear and supported by the third and fourth ball bearings with a wave washer inserted, and the fastening nut is threaded onto the elongated spindle of the planet cage; (g) a housing cap having a central opening mounted to said top end of said housing at said top opening with a portion of said fastening nut and a portion of said elongated spindle of said planet cage of said gear assembly extended out from the central opening of the housing cap; (h) an extending shank having a generally cylindrical hollow body with inner screw threads and two oppositely disposed flat outer surfaces, a proximal end threaded onto said elongated spindle of said planet cage of said gear assembly and a distal end configured as a nut; and (i) an eraser unit mounted to said extending shank including a generally disc shaped resilient eraser member having a round flat erasing surface, and a disc member embedded in the eraser member, where the disc member is assembled by a disc having a central opening for receiving a bolt and two oppositely disposed rim notches for preventing the eraser member from slipping, and the bolt has an elongated shaft extended through the central opening of the disc and fastened by an embedded nut, such that the elongated shaft of the bolt extends out eraser member and can be threaded into said distal end of said extending shank; (j) whereby said portable adhesive remover can be energized by a high pressure compressed air source and cause said resilient eraser member to rotate at a high speed, and when said resilient eraser member is engaged to the pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined broadly, the present invention is a portable vehicle adhesive remover comprising: (a) a hollow housing having a top end with a top opening, a bottom end with a bottom opening and a middle portion; (b) a throttler means including an air valve assembled inside said housing adjacent to its said bottom end and a throttle lever pivotally mounted to said housing adjacent to its said bottom end for regulating air passage; (c) a rotor means including a rotor rotatably supported by a first pair of ball bearings assembled inside said housing at its said middle portion; (d) a gear means including an internal gear and a planet cage having an elongated spindle supported by a second pair of ball bearings assembled inside said housing adjacent to its said top end; (e) a housing cap having an opening mounted to said top end of said housing and a cap nut threaded onto said elongated spindle of said planet cage of said gear means, such that a portion of the cap nut and portion of said elongated spindle of said planet cage of said gear means extends out from the central opening of the housing cap; (f) an extending shank having a proximal end attached to said elongated spindle of said planet cage of said gear means and a distal end configured as a nut; and (g) an eraser unit mounted to said extending shank including a resilient eraser member having an erasing surface, and a disc member embedded in the eraser member, where the disc member includes a disc having rim notches for preventing the eraser member from slipping and an elongated shaft extended out from the eraser member and removably attached to said distal end of said extending shank; (h) whereby said portable adhesive remover can be energized by a high pressure compressed air source and cause said resilient eraser member to rotate at a high speed and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined more broadly, the present invention is a portable vehicle adhesive remover comprising: (a) a housing having a top opening and a bottom opening; (b) a motor unit assembled inside said housing including a throttler means located adjacent to said bottom end, a gear means located adjacent to said top end and a rotor means located in between the throttler means and the gear means, the motor unit having an elongated spindle extending out from said top opening of said housing; (c) an extending shank having a proximal end attached to said elongated spindle of said motor unit, and a distal end; and (d) an eraser unit removably attached to said distal end of said extending shank including a resilient eraser member and a disc member embedded in the eraser member; (e) whereby said portable adhesive remover can be energized by a high pressure compressed air source and cause said resilient eraser member to rotate at a high speed and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined even more broadly, the present invention is a portable vehicle adhesive remover comprising: (a) a motor unit having an elongated spindle; (b) an extending shank having a proximal end attached to said elongated spindle of said motor unit, and a distal end; and (c) an eraser unit removably attached to said distal end of said extending shank including a resilient eraser member and a disc member embedded in the eraser member; (d) whereby said portable adhesive remover can be energized by high pressure compressed air source and cause said resilient eraser member to rotate in a high speed; when said resilient eraser member is engaged to the pinstripes, decals, side moldings and other adhered items on a vehicle, it can generate adequate heat to cause the adhesive to lose its adhesion and thus release the pinstripes, decals, side moldings and other adhered items, so they can be removed without damaging the paint or other body parts of the vehicle.

Defined most broadly, the present invention is a portable vehicle adhesive remover comprising a motor unit and an eraser unit, the eraser unit including a resilient eraser member and a disc member embedded in the eraser member removably attached to the motor unit, whereby said motor unit can rotate said eraser unit, so that when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined alternatively in detail, the present invention is an eraser assembly for a portable vehicle adhesive remover having an air die grinder motor unit with an elongated spindle, comprising: (a) an extending shank having a generally cylindrical hollow body with inner screw threads and two oppositely disposed flat outer surfaces, a proximal end threaded onto said elongated spindle of said motor unit and a distal end configured as a nut; and (b) an eraser unit including a generally disc shaped resilient eraser member having a round flat erasing surface and a disc member embedded in the eraser member, where the disc member is assembled by a disc having a central opening for receiving a bolt and two oppositely disposed rim notches for preventing the eraser member from slipping, and the bolt has an elongated shaft extended through the central opening of the disc and fastened by an embedded nut, such that the elongated shaft of the bolt extends out from the eraser member and can be threaded into said distal end of said extending shank; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined broadly, the present invention is an eraser assembly for a portable vehicle adhesive remover having an air die grinder motor unit with an elongated spindle, comprising: (a) an extending shank having a proximal end attached to said elongated spindle of said motor unit and a distal end configured as a nut; and (b) an eraser unit including a resilient eraser member having an erasing surface and a disc member embedded in said eraser member, where the disc member includes a disc having rim notches for preventing said eraser member from slipping, and an elongated shaft extended out from said eraser member and removably attached to said distal end of said extending shank; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined more broadly, the present invention is an eraser assembly for a portable vehicle adhesive remover having an air die grinder motor unit with an elongated spindle, comprising: (a) an extending shank having a proximal end attached to said elongated spindle of said motor unit, and a distal end; and (b) an eraser unit removably attached to said distal end of said extending shank including a resilient eraser member and a disc member embedded in the eraser member; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined even more broadly, the present invention is an eraser assembly for a portable vehicle adhesive remover having a motor unit, comprising: (a) an eraser unit including a resilient eraser member and a disc member embedded in the eraser member; and (b) an extending shank interconnecting said motor unit and said eraser unit; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined most broadly, the present invention is an eraser assembly for a portable vehicle adhesive remover having a motor unit, comprising an eraser unit including a resilient eraser member and a disc member embedded in the eraser member detachably attached to the motor unit, whereby said motor unit can rotate said eraser unit, so that when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Further defined in detail, the present invention is a portable preparation tool kit for automobile body work or the like, comprising: (a) a portable case for containing a multiplicity of tools, the case including a box with a lid, a recessed panel placed within the box for retaining the tools, and a transparent dust cover placed over the recessed panel; (b) said multiplicity of tools including a portable rotary tool with accessories, a multiplicity of abrasive tools, and a multiplicity of sand tools; (c) said portable rotary tool being an angle head rotary pneumatic motor having a housing assembly, a throttler assembly, a rotor assembly, a spindle assembly, and a collet assembly; (d) said housing assembly of said angle head rotary pneumatic motor including a cylindrical main housing for housing said throttler assembly and said rotor assembly, a locking ring, and an angle head housing for housing said spindle assembly and said collet assembly, the main housing having a top and a bottom, two opposite side openings located adjacent to the bottom, and a bottom port for receiving compressed air, the angle head housing mounted to the top of the main housing by the locking ring; (e) said throttler assembly of said angle head rotary pneumatic motor being assembled in a lower portion of said main housing and including a valve bushing, a valve, a valve spring, an air regulator, a valve screw, a lever, and a roll pin, where the valve bushing is mounted to said main housing at a first one of said two side openings, an end of the valve is inserted with the valve spring into the air regulator so that the valve spring tends to push the valve out to block air passage through the air regulator, an opposite end of the valve is stuck out from the first side opening through the valve bushing, the air regulator is located inside said main housing and supported by the valve screw, which is in turn mounted to said main housing at a second one of said two side openings, and the lever is pivotally attached by the roll pin to said bottom of said main housing adjacent to the first side opening against the stuck out end of the valve, so that the valve is pressed inwardly to allow air passage through the air regulator when the lever is held towards said main housing; (f) said rotor assembly of said angle head rotary pneumatic motor being assembled inside an upper portion of said main housing and including a lower ball bearing, a lower plate, two dowel pins, a rotor cylinder, a rotor with a multiplicity of rotor blades, a rotor collar, an upper plate, an upper ball bearing, a pinion, and a motor camp, where the rotor is located inside the rotor cylinder and supported by the lower and upper ball bearings, the lower and upper plates are attached to two respective ends of the rotor cylinder by the two dowel pins respectively, the motor camp is mounted to said top of said main housing, and the pinion is attached to the rotor and extends into said angle head housing; (g) said spindle assembly of said angle head rotary pneumatic motor being assembled inside said angle head housing and including a rear ball bearing, a gear, a front ball bearing, a spindle with a key, and a clamp nut, where the spindle is engaged with the gear through the key and supported by the rear and front ball bearings, the gear is engaged with said pinion of said rotor assembly, the spindle assembly is secured inside said angle head housing by the clamp nut, with a front portion of the spindle extending out of said angle head housing, the front portion of the spindle having two opposite flat surfaces, outer screw threads and an inner chamber; (h) said collet assembly including a collet and a collet nut, where the collet is retained within said inner chamber of said spindle, the collet nut having inner screws so that it can be fastened onto said front portion of said spindle for tightening the collet, the collet nut having two opposite flat surfaces; (i) said multiplicity of abrasive tools including a large abrasive tool set and a small abrasive tool set, the large abrasive tool set including a first elongated shaft, a large abrasive wheel base, and a multiplicity of large abrasive wheels, the small abrasive tool set including a second elongated shaft, a small abrasive wheel base, and a multiplicity of small abrasive wheels; (j) said multiplicity of sand tools including a large sand tool set and a small sand tool set, the large sand tool set including a large conical sand stone, a large spherical sand stone, a large cylindrical sand stone, a large round tipped cylindrical sand stone, and a large sharp tipped cylindrical sand stone, the small sand tool set including a small conical sand stone, a small spherical sand stone, a small cylindrical sand stone, a small round tipped cylindrical sand stone, and a small sharp tipped cylindrical sand stone, where each sand stone has a stem, and the stems of small sand stones are thinner than the stems of the small sand stones; (k) said collet of said pneumatic motor having an inner bore suitable for receiving said elongated shafts of said large and small abrasive tool sets and said stems of said large sand stones; and (l) said accessories of said portable rotary tool including a different sized alternative collet having an inner bore suitable for said stems of said small sand stones; (j) whereby said multiplicity of abrasive and sand tools can be interchangeably used with said pneumatic motor, and when high pressure compressed air is sent into said main housing and said lever is pressed, the compressed air will be gushed into said rotor assembly through said throttler assembly and blow said rotor blades to make said rotor rotate, and the rotation is transmitted to said spindle through said pinion and said gear, which in turn drives said abrasive wheel or sand stone attached to said pneumatic motor.

Further defined broadly, the present invention is a portable preparation tool kit for automobile body work or the like, comprising: (a) a portable case for containing a multiplicity of tools, the case having a recessed interior panel for retaining the tools; (b) said multiplicity of tools including a portable rotary tool with accessories, a multiplicity of abrasive tools, and a multiplicity of sand tools; (c) said portable rotary tool being an angle head rotary pneumatic motor having a housing assembly, a throttler assembly, a rotor assembly, a spindle assembly, and a collet assembly; (d) said housing assembly of said angle head rotary pneumatic motor including a cylindrical main housing and an angle head housing attached to a top end of the main housing; (e) said throttler assembly of said angle head rotary pneumatic motor being assembled in a lower portion of said main housing and including a spring biased valve and an air regulator controlled by a pivoted lever; (f) said rotor assembly of said angle head rotary pneumatic motor being assembled in an upper portion of said main housing and including a rotor having rotor blades and rotatably supported by bearings, and a pinion connected to the rotor and extending into said angle head housing; (g) said spindle assembly of said angle head rotary pneumatic motor being assembled inside said angle head housing and including a gear engaged with said pinion of said rotor assembly, and a spindle connected to the gear and having a hollow portion extending out of said angle head housing; (h) said collet assembly including a collet retained within said hollow portion of said spindle, and a collet nut fastened onto said spindle for tightening the collet; (i) said multiplicity of abrasive tools including at least two different sized abrasive tool sets, each including an elongated shaft, an abrasive wheel base, and a multiplicity of abrasive wheels; (j) said multiplicity of sand tools including at least two different sized sand tool sets, each including a multiplicity of different shaped sand stones having identical stems; (k) said collet of said pneumatic motor being suitable for receiving said elongated shaft of at least one of said at least two abrasive tool sets and said identical stems of at least one of said at least two sand tool sets; and (l) said accessories of said portable rotary tool including at least one different sized alternative collet suitable for receiving said elongated shaft of another one of said at least two abrasive tool sets and said identical stems of another one of said at least two sand tool sets; (j) whereby said multiplicity of abrasive and sand tools can be interchangeably used with said pneumatic motor, and when high pressure compressed air is sent into said main housing and said lever is pressed, the compressed air will be gushed into said rotor assembly through said throttler assembly and blow said rotor blades to make said rotor rotate, and the rotation is transmitted to said spindle through said pinion and said gear, which in turn drives said abrasive wheel or sand stone attached to said pneumatic motor.

Further defined more broadly, the present invention is a portable preparation tool kit for automobile body work or the like, comprising: (a) a portable case for containing a multiplicity of tools; (b) said multiplicity of tools including a portable rotary tool, a multiplicity of abrasive tools, and a multiplicity of sand tools; (c) said portable rotary tool being an angle head rotary pneumatic motor having a cylindrical main housing and an angle head housing, a throttler assembly assembled in a lower portion of the main housing and controlled by a pivoted lever, a rotor assembly assembled in an upper portion of the main housing and having a rotor with blades and a pinion connected to the rotor and extending into the angle head housing, a spindle assembly assembled inside the angle head housing and having a pinion geared with the pinion and extending out of the angle head housing; (d) said multiplicity of abrasive tools including at least one abrasive tool set which includes at least one elongated shaft, at least one abrasive wheel base, and a multiplicity of abrasive wheels; (e) said multiplicity of sand tools including at least one sand tool set which includes a multiplicity of different shaped sand stones having identical stems; and (f) said pneumatic motor having at least one collet attached to said spindle and being suitable for receiving said elongated shaft of said at least one abrasive tool set and said identical stems of said at least one sand tool sets; (g) whereby said multiplicity of abrasive and sand tools can be interchangeably used with said pneumatic motor, and when high pressure compressed air is sent into said main housing and said lever is pressed, the compressed air will be gushed into said rotor assembly through said throttler assembly and blow said rotor blades to make said rotor rotate, and the rotation is transmitted to said spindle through said pinion, which in turn drives said abrasive wheel or sand stone attached to said pneumatic motor.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A portable preparation tool kit for automobile body work or the like, comprising:

a. a portable case for containing a multiplicity of tools;

b. said multiplicity of tools including a portable rotary tool, a multiplicity of abrasive tools, and a multiplicity of sand tools;

c. said portable rotary tool being an angle head rotary pneumatic motor having a cylindrical main housing and an angle head housing, a throttler assembly assembled in a lower portion of the main housing and controlled by a pivoted lever, a rotor assembly assembled in an upper portion of the main housing and having a rotor with blades and a pinion connected to the rotor and extending into the angle head housing, a spindle assembly assembled inside the angle head housing and having a pinion geared with the pinion and extending out of the angle head housing;

d. said multiplicity of abrasive tools including at least one abrasive tool set which includes at least one elongated shaft, at least one abrasive wheel base, and a multiplicity of abrasive wheels;

e. said multiplicity of sand tools including at least one sand tool set which includes a multiplicity of different shaped sand stones having identical stems; and f. said pneumatic motor having at least one collet attached to said spindle and being suitable for receiving said elongated shaft of said at least one abrasive tool set and said identical stems of said at least one sand tool sets;

g. whereby said multiplicity of abrasive and sand tools can be interchangeably used with said pneumatic motor, and when high pressure compressed air is sent into said main housing and said lever is pressed, the compressed air will be gushed into said rotor assembly through said throttler assembly and blow said rotor blades to make said rotor rotate, and the rotation is transmitted to said spindle through said pinion, which in turn drives said abrasive wheel or sand stone attached to said pneumatic motor.

2. The invention as defined in claim 1 further comprising an air hose adapter attached to a bottom port of said main housing of said pneumatic motor for receiving compressed air.

3. A portable preparation tool kit for automobile body work or the like, comprising:

a. a portable case for containing a multiplicity of tools, the case including a box with a lid, a recessed panel placed within the box for retaining the tools, and a transparent dust cover placed over the recessed panel;

b. said multiplicity of tools including a portable rotary tool with accessories, a multiplicity of abrasive tools, and a multiplicity of sand tools;

c. said portable rotary tool being an angle head rotary pneumatic motor having a housing assembly, a throttler assembly, a rotor assembly, a spindle assembly, and a collet assembly;

d. said housing assembly of said angle head rotary pneumatic motor including a cylindrical main housing for housing said throttler assembly and said rotor assembly, a locking ring, and an angle head housing for housing said spindle assembly and said collet assembly, the main housing having a top and a bottom, two opposite side openings located adjacent to the bottom, and a bottom port for receiving compressed air, the angle head housing mounted to the top of the main housing by the locking ring;

e. said throttler assembly of said angle head rotary pneumatic motor being assembled in a lower portion of said main housing and including a valve bushing, a valve, a valve spring, an air regulator, a valve screw, a lever, and a roll pin, where the valve bushing is mounted to said main housing at a first one of said two side openings, an end of the valve is inserted with the valve spring into the air regulator so that the valve spring tends to push the valve out to block air passage through the air regulator, an opposite end of the valve is stuck out from the first side opening through the valve bushing, the air regulator is located inside said main housing and supported by the valve screw, which is in turn mounted to said main housing at a second one of said two side openings, and the lever is pivotally attached by the roll pin to said bottom of said main housing adjacent to the first side opening against the stuck out end of the valve, so that the valve is pressed inwardly to allow air passage through the air regulator when the lever is held towards said main housing;

f. said rotor assembly of said angle head rotary pneumatic motor being assembled inside an upper portion of said main housing and including a lower ball bearing, a lower plate, two dowel pins, a rotor cylinder, a rotor with a multiplicity of rotor blades, a rotor collar, an upper plate, an upper ball bearing, a pinion, and a motor camp, where the rotor is located inside the rotor cylinder and supported by the lower and upper ball bearings, the lower and upper plates are attached to two respective ends of the rotor cylinder by the two dowel pins respectively, the motor camp is mounted to said top of said main housing, and the pinion is attached to the rotor and extends into said angle head housing;

g. said spindle assembly of said angle head rotary pneumatic motor being assembled inside said angle head housing and including a rear ball bearing, a gear, a from ball bearing a spindle with a key, and a clamp nut, where the spindle is engaged with the gear through the key and supported by the rear and front ball bearings, the gear is engaged with said pinion of said rotor assembly, the spindle assembly is secured inside said angle head housing by the clamp nut, with a front portion of the spindle extending out of said angle head housing, the front portion of the spindle having two opposite flat surfaces, outer screw threads and an inner chamber;

h. said collet assembly including a collet and a collet nut, where the collet is retained within said inner chamber of said spindle, the collet nut having inner screws so that it can be fastened onto said front portion of said spindle for tightening the collet, the collet nut having two opposite flat surfaces;

i. said multiplicity of abrasive tools including a large abrasive tool set and a small abrasive tool set, the large abrasive tool set including a first elongated shaft, a large abrasive wheel base, and a multiplicity of large abrasive wheels, the small abrasive tool set including a second elongated shaft, a small abrasive wheel base, and a multiplicity of small abrasive wheels;

j. said multiplicity of sand tools including a large sand tool set and a small sand tool set, the large sand tool set including a large conical sand stone, a large spherical sand stone, a large cylindrical sand stone, a large round tipped cylindrical sand stone, and a large sharp tipped cylindrical sand stone, the small sand tool set including a small conical sand stone, a small spherical sand stone, a small cylindrical sand stone, a small round tipped cylindrical sand stone, and a small sharp tipped cylindrical sand stone, where each sand stone has a stem, and the stems of small sand stones are thinner than the stems of the small sand stones;

k. said collet of said pneumatic motor having an inner bore suitable for receiving said elongated shafts of said large and small abrasive tool sets and said stems of said large sand stones; and l. said accessories of said portable rotary tool including a different sized alternative collet having an inner bore suitable for said stems of said small sand stones;

j. whereby said multiplicity of abrasive and sand tool can be interchangeably used with said pneumatic motor, and when high pressure compressed air is sent into said main housing and said lever is pressed, the compressed air will be gushed into said rotor assembly through said throttler assembly and blow said rotor blades to make said rotor rotate, and the rotation is transmitted to said spindle through said pinion and said gear, which in turn drives said abrasive wheel or sand stone attached to said pneumatic motor.

4. The invention as defined in claim 3 wherein said case further comprising an interlocking means for locking said box and said lid.

5. The invention as defined in claim 3 wherein said throttle assembly further comprising a valve "O" ring inserted into said air regulator with said valve and said valve spring.

6. The invention as defined in claim 3 wherein said throttle assembly further comprising a regulator "O" ring installed between said air regulator and said valve screw.

7. The invention as defined in claim 3 wherein said throttle assembly further comprising a valve screw "O" ring installed between said valve screw and said main housing.

8. The invention as defined in claim 3 wherein said accessories of said portable rotary tool further comprises an air hose adapter which can be attached to said main housing of said pneumatic motor at said bottom port for receiving compressed air.

9. The invention as defined in claim 3 wherein said accessories of said portable rotary tool further comprises a spindle wrench adaptable to said opposite flat surfaces on said spindle for facilitating the fastening or loosening of said collet nut.

10. The invention as defined in claim 3 wherein said accessories of said portable rotary tool further comprises a collet nut wrench adaptable to said opposite flat surfaces on said collet nut for facilitating the fastening or loosening of said collet or said alternative collet.

11. A portable preparation tool kit for automobile body work or the like, comprising:

a. a portable case for containing a multiplicity of tools, the case having a recessed interior panel for retaining the tools;

b. said multiplicity of tools including a portable rotary tool with accessories, a multiplicity of abrasive tools, and a multiplicity of sand tools;

c. said portable rotary tool being an angle head rotary pneumatic motor having a housing assembly, a throttler assembly, a rotor assembly, a spindle assembly, and a collet assembly;

d. said housing assembly of said angle head rotary pneumatic motor including a cylindrical main housing and an angle head housing attached to a top end of the main housing;

e. said throttler assembly of said angle head rotary pneumatic motor being assembled in a lower portion of said main housing and including a spring biased valve and an air regulator controlled by a pivoted lever;

f. said rotor assembly of said angle head rotary pneumatic motor being assembled in an upper portion of said main housing and including a rotor having rotor blades and rotatably supported by bearings, and a pinion connected to the rotor and extending into said angle head housing;

g. said spindle assembly of said angle head rotary pneumatic motor being assembled inside said angle head housing and including a gear engaged with said pinion of said rotor assembly, and a spindle connected to the gear and having a hollow portion extending out of said angle head housing;

h. said collet assembly including a collet retained within said hollow portion of said spindle, and a collet nut fastened onto said spindle for tightening the collet;

i. said multiplicity of abrasive tools including at least two different sized abrasive tool sets, each including an elongated shaft, an abrasive wheel base, and a multiplicity of abrasive wheels;

j. said multiplicity of sand tools including at least two different sized sand tool sets, each including a multiplicity of different shaped sand stones having identical stems;

k. said collet of said pneumatic motor being suitable for receiving said elongated shaft of at least one of said at least two abrasive tool sets and said identical stems of at least one of said at least two sand tool sets; and l. said accessories of said portable rotary tool including at least one different sized alternative collet suitable for receiving said elongated shaft of another one of said at least two abrasive tool sets and said identical stems of another one of said at least two sand tool sets;

j. whereby said multiplicity of abrasive and sand tools can be interchangeably used with said pneumatic motor, and when high pressure compressed air is sent into said main housing and said lever is pressed, the compressed air will be gushed into said rotor assembly through said throttler assembly and blow said rotor blades to make said rotor rotate, and the rotation is transmitted to said spindle through said pinion and said gear, which in turn drives said abrasive wheel or sand stone attached to said pneumatic motor.

12. The invention as defined in claim 11 wherein said throttle assembly further comprising a valve "O" ring inserted into said air regulator with said valve and said valve spring.

13. The invention as defined in claim 11 wherein said accessories of said portable rotary tool further comprises an air hose adapter attachable to a bottom port of said main housing of said pneumatic motor for receiving compressed air.

14. The invention as defined in claim 11 wherein said spindle further has flat outer surfaces, and said accessories further comprises a spindle wrench adaptable to the flat surfaces on said spindle for facilitating the fastening or loosening of said collet nut.

15. The invention as defined in claim 11 wherein said collet nut further has flat outer surfaces, and said accessories further comprises a collet nut wrench adaptable to the flat surfaces on said collet nut for facilitating the fastening or loosening of said collect or said alternative collet.

16. The invention as defined in claim 11 wherein said multiplicity of sand tools includes a large sand tool set and a small sand tool set.

17. The invention as defined in claim 16 wherein said large sand tool set includes a large conical sand stone, a large spherical sand stone, a large cylindrical sand stone, a large round tipped cylindrical sand stone, and a large sharp tipped cylindrical sand stone.

18. The invention as defined in claim 16 wherein said small sand tool set includes a small conical sand stone, a small spherical sand stone, a small cylindrical sand stone, a small round tipped cylindrical sand stone, and a small sharp tipped cylindrical sand stone.

* * * * *